US005730311A

United States Patent [19]

Curtis

[11] Patent Number: 5,730,311

[45] Date of Patent: Mar. 24, 1998

[54] CONTROLLED ATMOSPHERE PACKAGE

[75] Inventor: Danny S. Curtis, Naperville, Ill.

[73] Assignee: Tenneco Packaging Inc., Evanston, Ill.

[21] Appl. No.: 556,271

[22] Filed: Nov. 13, 1995

[51] Int. Cl.[6] ..... A61L 2/00

[52] U.S. Cl. ..... 220/371; 206/508

[58] Field of Search ..... 206/508; 220/202, 220/369, 370, 371, 372

[56] References Cited

U.S. PATENT DOCUMENTS

| | | | |
|---|---|---|---|
| 2,732,092 | 1/1956 | Lawrence | 220/371 |
| 3,083,861 | 4/1963 | Amberg et al. | 220/371 |
| 3,363,395 | 1/1968 | King | 53/112 |
| 3,481,100 | 12/1969 | Bergstrom | 53/22 |
| 3,545,163 | 12/1970 | Mahaffy et al. | 53/22 |
| 3,574,642 | 4/1971 | Weinke | 99/174 |
| 3,587,839 | 6/1971 | Brecht et al. | 206/46 |
| 3,634,993 | 1/1972 | Pasco et al. | 53/22 A |
| 4,340,138 | 7/1982 | Bernhardt | 206/216 |
| 4,349,999 | 9/1982 | Mahaffy et al. | 53/128 |
| 4,411,122 | 10/1983 | Cornish et al. | 53/436 |
| 4,517,206 | 5/1985 | Murphy et al. | 426/115 |
| 4,574,174 | 3/1986 | McGonigle | 219/10.55 M |
| 4,593,816 | 6/1986 | Langenbeck | 206/508 X |
| 4,622,229 | 11/1986 | Toshitsugu | 426/395 |
| 4,661,326 | 4/1987 | Schainholz | 220/371 X |
| 4,685,274 | 8/1987 | Garwood | 53/433 |
| 4,704,254 | 11/1987 | Nichols | 220/371 X |
| 4,728,504 | 3/1988 | Nichols | 220/371 X |
| 4,765,499 | 8/1988 | von Reis et al. | 220/371 X |
| 4,783,321 | 11/1988 | Spence | 220/371 X |
| 4,840,271 | 6/1989 | Garwood | 206/213.1 |
| 5,025,611 | 6/1991 | Garwood | 53/509 |
| 5,101,611 | 4/1992 | Biskup et al. | 53/433 |
| 5,103,618 | 4/1992 | Garwood | 53/433 |
| 5,115,624 | 5/1992 | Garwood | 53/427 |
| 5,129,512 | 7/1992 | Garwood | 206/213.1 |
| 5,155,974 | 10/1992 | Garwood | 53/510 |
| 5,226,531 | 7/1993 | Garwood | 206/213.1 |
| 5,323,590 | 6/1994 | Garwood | 53/433 |
| 5,334,405 | 8/1994 | Gorlich | 426/396 |
| 5,348,752 | 9/1994 | Gorlich | 426/129 |
| 5,384,103 | 1/1995 | Miller | 206/508 X |
| 5,409,126 | 4/1995 | DeMars | 206/508 X |

OTHER PUBLICATIONS

Albert Elboudwarej, Ph.D. "Application of Modified Atmosphere Packaging in Food Industry," pp. 1–18, date unknown.

AIRO brochure "Modified Atmosphere Packaging: Information Guide," pp. 1–8, date unknown.

*Primary Examiner*—Steven M. Pollard

*Attorney, Agent, or Firm*—Arnold, White & Durkee

[57] ABSTRACT

A package for maintaining a modified atmosphere around contents being contained therein when stored in an ambient environment is set forth. The modified-atmosphere package includes a tray, a membrane, and a structural member. The tray has a base and side walls extending upwardly from the base. The side walls and the base define a cavity wherein the contents are disposed. A membrane is attached to a top portion of the side walls and encloses the cavity. The structural member is detachably connected to the top portion of the side walls and is disposed above the membrane to prevent the membrane from contacting an external structure which inhibits permeation through the membrane. The structural member also has at least one opening for exposing the membrane to the ambient environment. Stacking means at the base of the tray and the top of the structural member allow the modified-atmosphere packages to be easily stacked. A vented-environment package is also shown which is very similar to the modified-atmosphere package except the permeable membrane is absent and the tray has at least one opening at its base. This opening on the lid is at least partially aligned with the base opening on the tray and simultaneously exposed to the ambient environment when two vented-environment packages are stacked. The lids utilized on the vented-environment package and the modified-atmosphere package are interchangeable.

25 Claims, 6 Drawing Sheets

CONTROLLED ATMOSPHERE PACKAGE

FIELD OF THE INVENTION

The present invention relates generally to a controlled atmosphere package for foods. More particularly, the invention relates to a modified-atmosphere package and a vented-environment package which inhibit the spoilage of food contained therein.

BACKGROUND OF THE INVENTION

Containers have long been employed to store and transfer food prior to presenting the food at a market where it will be purchased by the consumer. After meats, fruits, and vegetables are harvested, they are placed into containers to preserve those foods for as long as possible. Maximizing the time in which these foods remain preserved in the containers increases the profitability of all entities in the chain of distribution by minimizing the amount of spoilage.

The environment around which the foods are preserved is the most critical factor in the preservation process. Not only is maintaining an adequate temperature important, but the molecular content of the gases surrounding these foods is significant as well. By providing an appropriate gas content to the environment surrounding the food, the food can be better preserved when maintained at the proper temperature or even when it is exposed to variations in temperature. This gives the food producer some assurance that after the food leaves his or her control, the food will be in an acceptable condition when it reaches the consumer.

Each type of food has an optimum gas concentration in which it is best preserved. For example, fish and crustaceans are much better preserved when exposed to high levels of carbon dioxide ($CO_2$) such as 60% to 80%. On the hand, beef turns brown in the absence of oxygen ($O_2$) and the proper mixture is approximately 80% $O_2$ and 20% $CO_2$. Alternatively, poultry preserves best when exposed to nitrogen ($N_2$) and carbon dioxide with the ideal concentration being approximately 75% $N_2$ and 25% $CO_2$.

With respect to fruits and vegetables, the spoilage process is quite different than for meats because fruits and vegetables remain alive after harvesting. Fruits and vegetables undergo a process known as respiration in which they take in oxygen and give off heat energy, carbon dioxide, water vapor, and occasionally ethylene. Each species has a different respiration rate. The respiration rate is also affected by external factors, namely, the carbon dioxide concentration, the oxygen concentration, the temperature, and the ethylene concentration. Generally, a species' tolerance to spoilage at typical storage temperatures is enhanced by maintaining oxygen levels above 5% while maintaining carbon dioxide levels below 20%. However, it is also desirable to keep aerobic bacteria from growing and multiplying which is accomplished by maintaining a lower oxygen level. But anaerobic bacteria, such as Clostridium botulinim, will grow if no oxygen is present. As such, the balance between these competing factors typically results in a concentration of oxygen of less than 10% but greater than 5% for most fruits and vegetables. The remainder of the gas is nitrogen until respiration occurs which results in the addition of carbon dioxide, ethylene, and water vapor. To limit respiration and prevent rapid spoilage, it is desirable to continuously modify the gaseous environment surrounding the food by replenishing the supply of oxygen which is consumed and removing the byproducts which are produced during respiration.

To assist in the transmission of oxygen into the container and in the removal of carbon dioxide, ethylene, and water vapor from the container, permeable polymer films, or membranes, have been employed. In some situations, it is best to use a membrane with a high permeability to gases so that those gases can be readily transferred into and from the container. In other situations, it is best to maintain the initial environmental gas concentration, such as when meats are packaged, which can be done by use of a membrane with a low permeability. Generally, the rate at which a specific gas permeates through a membrane is proportional to the difference between the concentrations of that specific gas on both sides of the permeable membrane. If there is 0% carbon dioxide on one side of the membrane and a high concentration of carbon dioxide on the other, permeation would be high. On the other hand, if air with 20% oxygen is on both sides of the membrane, permeation would be low.

The permeation rate from a container is proportional to the surface area of the permeable membrane. So to ensure that the appropriate permeation is accomplished, the surface area cannot be obstructed. Otherwise, permeation from the surface will not occur. As can be expected, this problem is often encountered during storage and shipping in which numerous containers having these permeable film membranes are located adjacent each other. When the containers are stacked, the problem is accentuated as the likelihood that a portion of the permeable membrane will be obstructed vastly increases.

Considering that heat is also a byproduct of the respiration process and maintaining lower temperatures is desirable, some fruits and vegetables such as strawberries require the heat to be dissipated. If not, then the increased temperature will cause increased respiration resulting in a "snowball" effect and a quickly spoiled product. In these situations, the use of a contained environment augmented by a permeable membrane is not advantageous since such a configuration would tend to contain the heat. Instead, no membrane is used in this type of package and additional vents are provided to allow unimpeded access of cool gas around the product. However, when these packages are stacked vertically to use less space in storage and transportation, the vent holes can be obstructed due to the stacking configuration. Attempts have been made to align the vents on the base of one container to the lid of another to keep a free flow of air between adjacent containers and dissipate the heat. However, as the heat rises from the lowest stacked container into the vertically adjacent container, it raises the temperature in that container as well. As the warm air continues to rise from package to package, the heat increases such that the temperature of the air around the food in the top package in the stack can become unacceptably high.

Attempts have also been made to place vents on the side of the tray. But, the addition of any openings on the tray can comprise the structural integrity of the package. And since the vast majority of containers today are made of less costly, thin polymers, the strength issue is a major concern. Furthermore, additional openings along the side of the package makes the enclosed food more susceptible to exposure to moisture, dirt, insects and the like during storage and transportation.

As the tastes of consumers continue to transition from canned and frozen foods to fresh foods, the need for improved containers is growing. Such an improved container must overcome the aforementioned shortcomings associated with occlusion of the surface of the permeable membrane and maintaining the appropriate environment during stacking.

SUMMARY OF THE INVENTION

Briefly, the present invention is directed to new and improved containers for transporting and storing food. More particularly, the invention relates to a modified-atmosphere package and a vented-environment package which inhibit the spoilage of food contained therein.

The modified-atmosphere package maintains an appropriate contained atmosphere around contents being contained therein when stored in an ambient environment. The modified-atmosphere package includes a tray, a permeable membrane, and a lid. The tray has a base and side walls extending upwardly from the base. The side walls and the base define a cavity wherein the contents are disposed. A permeable membrane is attached to a top portion of the side walls and encloses the cavity. The lid is detachably connected to the top portion of the side walls and is disposed above the membrane to prevent the membrane from contacting an external structure which inhibits permeation through the membrane. The lid also has at least one opening for exposing the membrane to the ambient environment. Stacking means at the base of the tray and the top of the lid allow multiple modified-atmosphere packages to be easily stacked without obstructing the membrane. The modified-atmosphere package is useful when the skins of a fruit or vegetable have been broken and the contents need to be protected from high levels of oxygen which will cause rapid spoilage.

A vented-environment package is also shown which is very similar to the modified-atmosphere package except the permeable membrane is absent and the tray has at least one opening at its base. The opening on the lid is at least partially aligned with the opening on base of the tray and simultaneously exposed to the ambient environment when two vented-environment packages are stacked. Air is permitted to flow through the opening at the base of the tray, past the foods contained in the vented-environment package, and out of the openings in the lid. The vented-environment is useful for fruits and vegetables which have not had their exterior skins cut open and require a vented ambient air environment.

The lids utilized on the vented-environment package and the modified-atmosphere package are interchangeable. Thus, the producer of the goods can utilize one lid and two trays to package a wide variety of goods.

The above summary of the presented invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
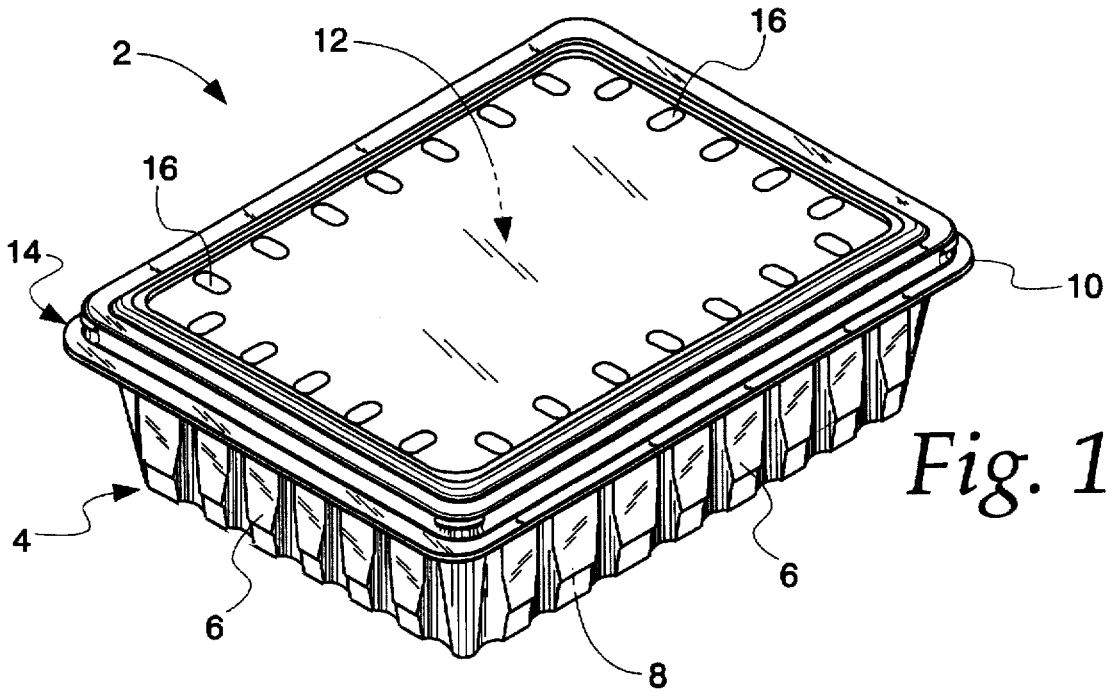
FIG. 1 is an isometric view of a modified-atmosphere package.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF THE PREFERRED EMBODIMENT

Figure 2:
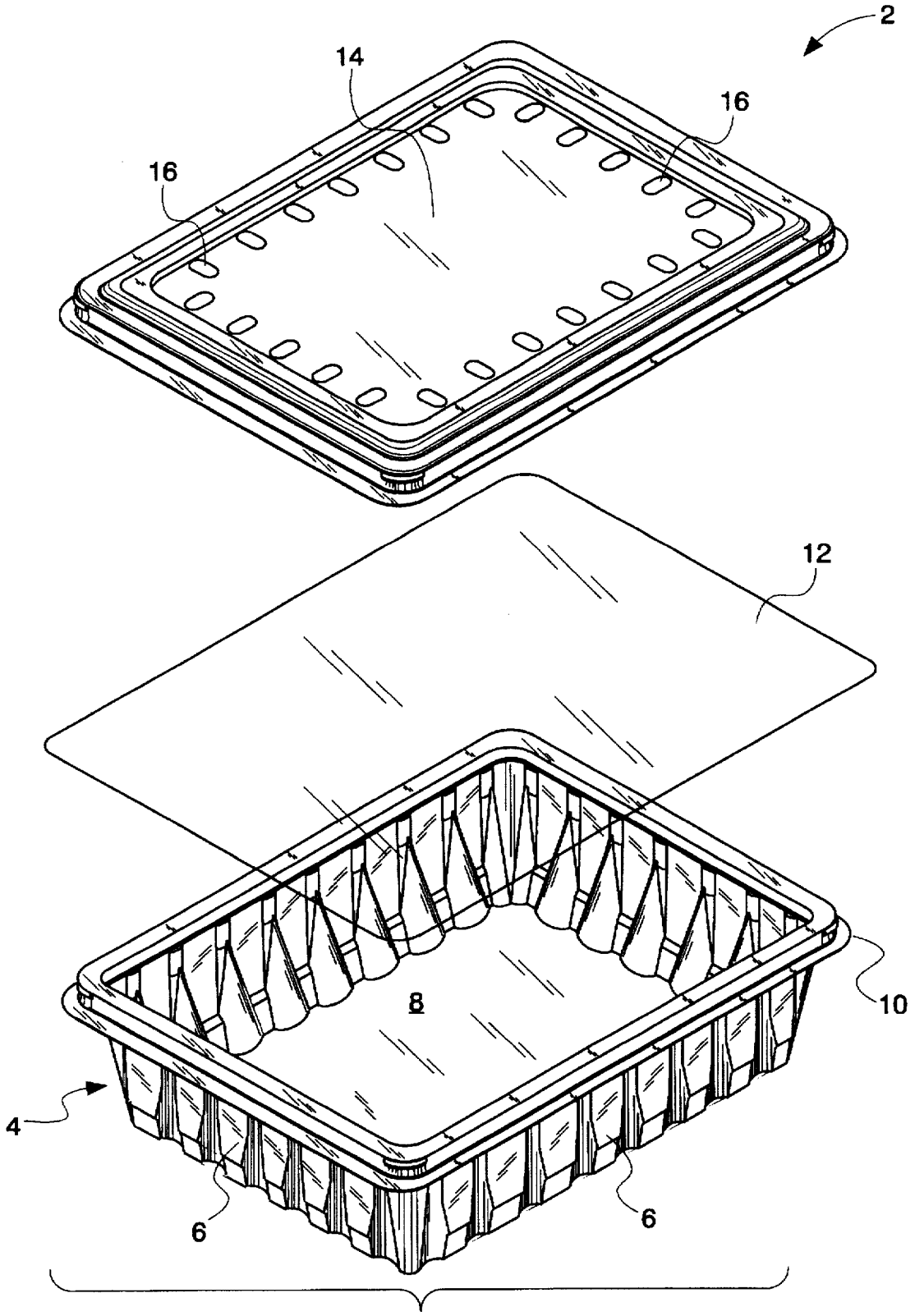
FIG. 2 is an exploded isometric view of the modified-atmosphere package.

Referring initially to FIG. 1, a modified-atmosphere package 2 is illustrated. The modified-atmosphere package 2 includes a tray 4 having side walls 6 and a base 8 from which the side walls 6 extend upwardly. Upper portions of the side walls 6 generally have an outwardly extending flange 10 which defines the periphery of the modified-atmosphere package 2. A membrane 12 is attached along the upper portion of the side walls 6 which completely encloses the cavity defined by the side walls 6 and the base 8. Generally, the membrane 12 is attached to the modified-atmosphere package 2 by a heat-sealing process. The modified-atmosphere package 2 also has a lid 14 which is detachably connected to the upper portion of the side walls 6 at the flange 10. Thus, when initially packaged, the lid 14 may contact edges of the membrane 12 which are attached to the modified-atmosphere package 2 when the lid 14 is connected to the flange 10. After the initial opening, the consumer may discard the membrane 12 or stretch it back over the flange 10 and reconnect the lid 14. The tray 4, the membrane 12, and the lid 14 are more easily visualized in FIG. 2 which is an exploded view of FIG. 1.

The lid 14 includes a plurality of openings 16 which allow the membrane 12 to be exposed to the ambient environment. This is important in that when the food contained within the tray 4 undergoes respiration, the membrane 12 acts as a valve which permits the resultant carbon dioxide, ethylene, and water vapor produced by the respiration process to permeate through the membrane 12 while oxygen from the ambient environment is replenished into the cavity through the membrane 12. If the lid 14 had no openings 16, this exchange of gases through the membrane 12 would be limited to the volume of gas underneath the lid 14.

The permeation rate through the membrane 12 is proportional to the carbon dioxide concentration, the oxygen concentration, the ethylene concentration, and the amount of the food product contained. The material from which the membrane 12 is made also dictates the permeability rates. When a package is designed for a specific meat, vegetable, or fruit, the material is chosen which will suit the needs of that particular food contained in the tray 4. However, if the effective surface area of the permeable membrane 12 is reduced due to an adjacent package or object abutting against the membrane 12, then the efforts in designing the package are wasted. When part of the surface area of the membrane 12 is covered, it cannot exchange the gas in that region and the desired gas concentrations are not maintained which leads to quicker spoilage. It should be noted that the side walls 6 and the base 8 may also be a path through which the gases permeate. However, in comparison to the thin membrane 12, these surfaces have a negligible permeation rate. But, the modified-atmosphere package 2 could be designed with multiple surfaces having permeable membranes.

The lid 14 ensures that no object or adjacent package obstructs the surface area of the membrane 12. To effectuate this result, the lid 14 is relatively rigid to resist the force from an adjacent object while the openings 16 allow free movement of the ambient air around the membrane 12. The lid 14 also protects the thin membrane 12 from tearing which can easily occur during storage and transportation if it comes in contact with a sharp object. Furthermore, the addition of the lid 14 makes the product more marketable since consumers are more apt to purchase goods packaged in structurally sound packages since those goods are less likely to have been damaged during the distribution process.

Although the lid 14 is shown with multiple openings 16, the same function could be performed with less openings 16 as long as ambient air is free to move within the region between the lid 14 and the membrane 12. Furthermore, the lid 14 could be reduced in its complexity and be simply a wire-frame structure to keep adjacent objects from contacting the membrane. This type of design uses much less material than the completely encompassing lid 14 shown in FIGS. 1 and 2. Additionally, the modified-atmosphere package 2 can have a curvilinear shape as well as the polygonal shape shown in FIGS. 1 and 2.

Figure 3:
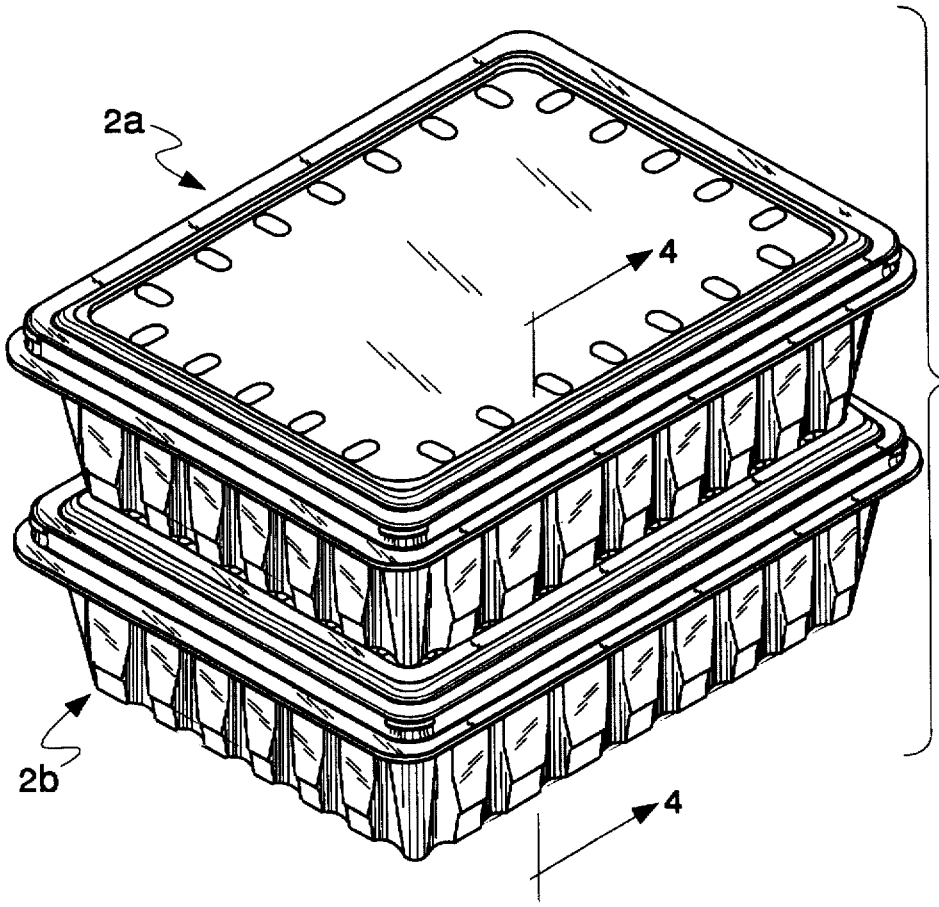
FIG. 3 is an isometric view of two stacked modified-atmosphere packages.

FIG. 3 illustrates an upper modified-atmosphere package 2*a* which has been vertically stacked on a lower modified-atmosphere package 2*b*. This provides for a minimal storage volume as well as a structurally sound means in which to transport multiple modified-atmosphere packages 2*a* and 2*b*. Thus, an ability to vertically stack the modified-atmosphere packages 2 is a requirement for them to be commercially practical.

Figure 4:
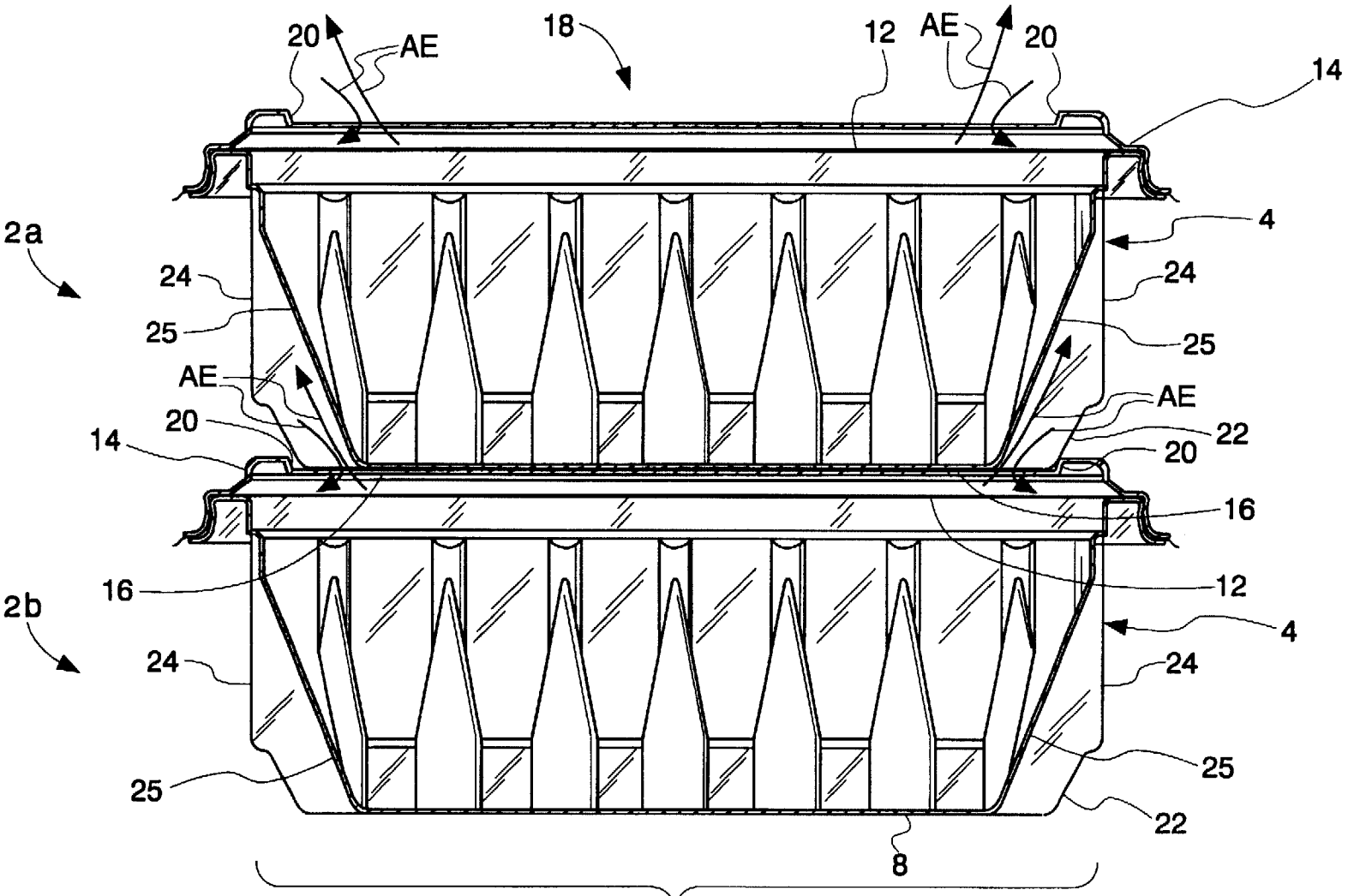
FIG. 4 is a cross-sectional view of the two stacked packages in FIG. 3 taken along line 4—4.

The details of the stacking features are shown in FIG. 4. The lid 14 includes a stacking recess 18 created by vertical stacking walls 20. The base 8 of each of the trays 4 includes a downwardly extending stacking projection 22. The stacking projection 22 can be merely walls which extend downwardly from the base 8. Alternatively, the shape of the base 8 itself can suffice as the stacking projection.

The stacking projection 22 on the tray 4 mates into the stacking recess 18 of the lid 14. This stacking function could be accomplished in various alternative methods. For example, the base 8 could be equipped with an upwardly projecting recess and the lid 14 could have a corresponding projection. Alternatively, multiple recesses and corresponding projections could be placed on these components.

Figure 5:
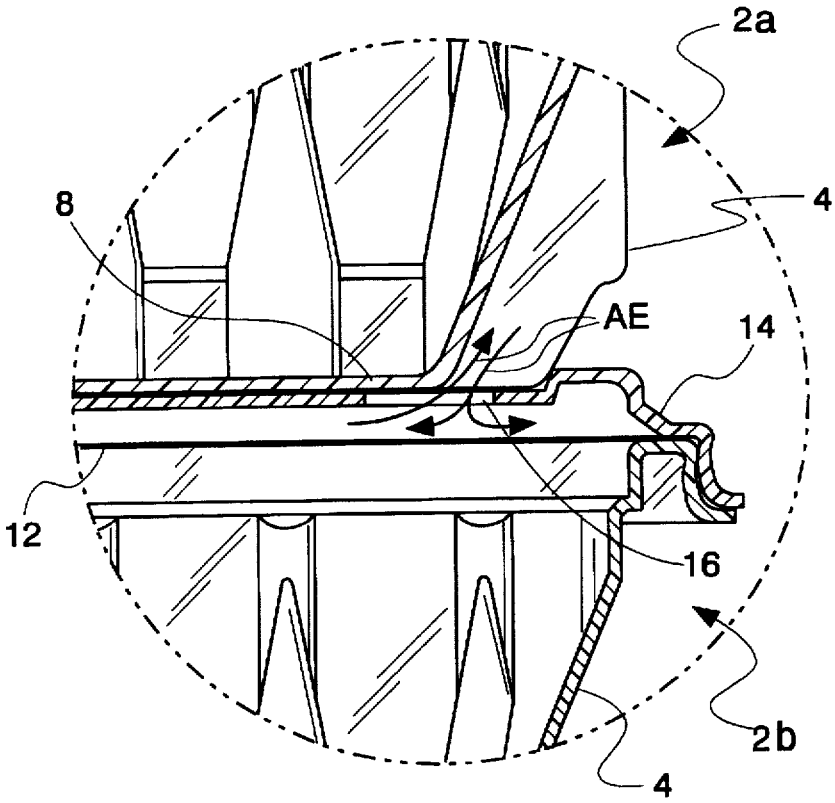
FIG. 5 is an enlarged cross-sectional view illustrating the communication of the opening in the lid on stacked packages in FIG. 4.

FIG. 5 illustrates the interaction between the openings 16 and the ambient AE. Regardless of which stacking methodology is employed, a primary concern is that the openings 16 are exposed to an ambient environment AE when the upper modified-atmosphere package 2*a* is stacked on the lower modified-atmosphere package 2*b* as shown in FIGS. 3–5. The ambient environment AE is permitted to circulate across the membrane 12 of the lower modified-atmosphere package 2*b*. This allows the proper exchange of gases across the membrane 12 although the two packages 2*a* and 2*b* are stacked directly on one another.

Several design features permit the exposure of the membrane 12 to the ambient environment AE. The trays 4 include multiple ribs 24 which add structural stability to the trays 4. More importantly, each pair of ribs 24 on the upper modified-atmosphere package 2*a* provides an indentation 25 extending toward the inside of the tray 4 which exposes the openings 16 of the lid 14 of the lower modified-atmosphere package 2*b* to the ambient environment AE. Thus, stacking of multiple packages 2*a* and 2*b* is accomplished with the openings 16 of the lower modified-atmosphere package 2*b* aligned to the indentations 25 on the tray 4 of the upper modified-atmosphere package 2*a*. Although in the embodiment shown the ribs 24 providing these indentations 25 are structural, indentations which do not add to the structural integrity, but merely provide access to the openings 16 can be employed. And, the openings 16 could be moved outside the walls 20 of the stacking recess 18 to ensure no obstruction would occur while stacking. The reason that FIGS. 1–5 show the openings 16 on the inside of the walls 20 is that this lid 14 is interchangeable with a vented-environment package which will be described below in reference to FIGS. 6–8.

The modified-atmosphere package 2 is very useful for packaging fruits or vegetables which have had their skins punctured or opened during the packaging process. The skin is a natural protective membrane which exchanges gases during respiration. When the skin is cut to expose the internal portions, the modified-atmosphere package 2 then acts like the skin to regulate respiration.

The tray 4 of the modified-atmosphere package 2 is typically made of a polymeric material such as polystyrene, polyester, or polypropylene to name a few. Generally, the thickness of the tray 4 is about 0.005 inch to about 0.040 inch depending on the material chosen and the size of the modified-atmosphere package 2. The lid 14 is typically made of a polymeric material such of polystyrene, polyester, or polypropylene with numerous other alternatives available. Again, the thickness of the material of the lid 14 ranges from roughly 0.005 inch to about 0.040 inch. Generally, the tray 4 and the lid 14 are thermoformed. If the membrane 12 must be permeable, it can be made of a polymeric material such as polystyrene, polypropylene, polyethylene or various polymers in the vinyl group. Alternatively, a more impervious membrane 12 can be made of materials such as polyvinylidene chloride or ethylene vinyl alcohol in combination with polyethylene. The membrane 12 generally is 0.0005 inch or less in thickness. As stated previously, the protection provided by the lid 14 allows many types of lower strength materials to be used for the membrane 12 which normally could not be used if no lid 14 was present.

The modified-atmosphere package 2 could also be accomplished by having lid 14 connected to the tray 4 during the fabrication process at a hinge. Thus, these two components of the modified-atmosphere package 2 are produced simultaneously. After the food is placed within the tray 4, the membrane 12 is then heat-sealed to the tray 4. Finally, the lid 14 is rotated around the hinge and connected to the flange 10. In another alternative, the base 8 of the tray 4 could have a downwardly extending bottom flange. This bottom flange then mates with the flange 10 on the upper portion of the side walls 6 of the modified-atmosphere package 2 which is situated in a stack just below it. Thus, the tray 4 has both required stacking features. This bottom flange has openings through which air could pass when the packages are stacked.

Figure 6:
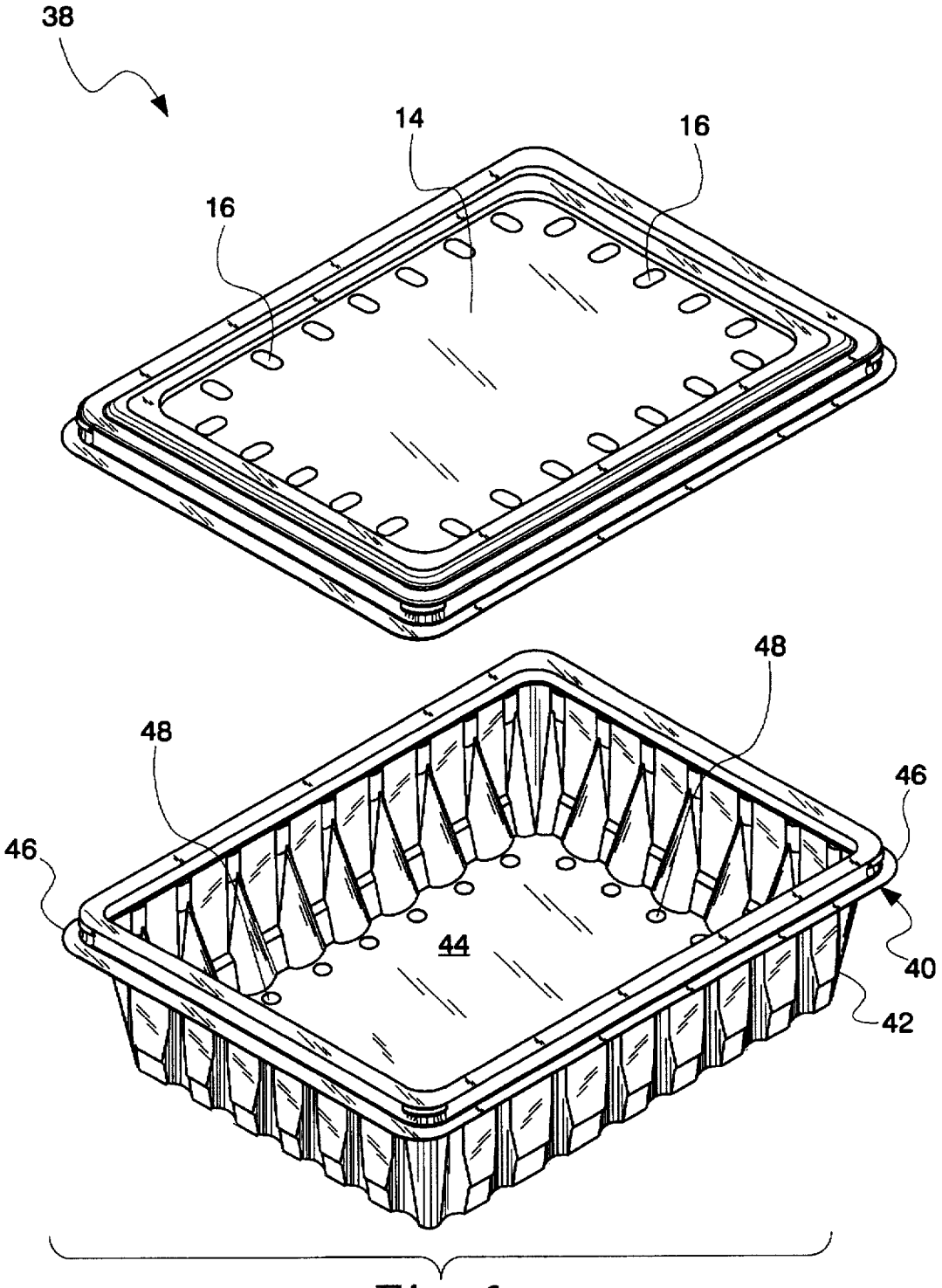
FIG. 6 is an exploded isometric view of a vented-environment package.

FIG. 6 illustrates an exploded view of a vented-environment package 38 which includes a vented-environment tray 40 and the lid 14 as described in reference to FIGS. 1–5. The vented-environment tray 40 and the lid 14 are detachably connected to each other to form the vented-environment package 38. The vented-environment tray 40 includes side walls 42 and a base 44. A flange 46 extends around the upper portion of the side walls 42. The main difference between the vented-environment tray 40 and the tray 4 of FIGS. 1–5 is that the vented-environment tray 40 includes base openings 48 along its base 44. The vented-environment tray 40 is useful for storing fruits and vegetables which have not had their external skins opened during the packaging process. The vented-environment tray 40 utilizes approximately the same thicknesses and materials as described in reference to tray 4 of FIGS. 1–5.

Although the vented-environment package 38 uses the same lid 14 as in FIGS. 1–5, it does not incorporate the permeable membrane 12. With no permeable membrane 12, gases from the ambient environment flow freely from the base openings 48, through the vented-environment package 38 adjacent the food, and out of the openings 16 in the lid 14. After a fruit or vegetable is harvested and packaged, the ongoing respiration process produces heat, carbon dioxide, water vapor, and ethylene which must be evacuated from the environment surrounding the food. As the heat raises the temperature of the gases immediately adjacent the surface of the food, those gases rise within the vented-environment package 38 due to the reduction in the gas density associated with an increase in temperature. As the warmer gases collect at the top of the vented-environment package 38 along the underside of the lid 14, the warm gases leak from the openings 16 in the lid 14. To maintain a pressure equilibrium with the ambient environment, gases from the ambient environment are then drawn into the vented-environment package 38 through the lower base openings 48. Because the gases in the ambient environment are generally cooler than the warmer gases which escape from the vented-environment package 38, the products within the vented-environment package 38 constantly have cool fresh ambient air passing by them. This process of removing the heat by natural convection provides an adequate cooling effect on the food which, in turn, reduces the respiration rate.

Figure 7:
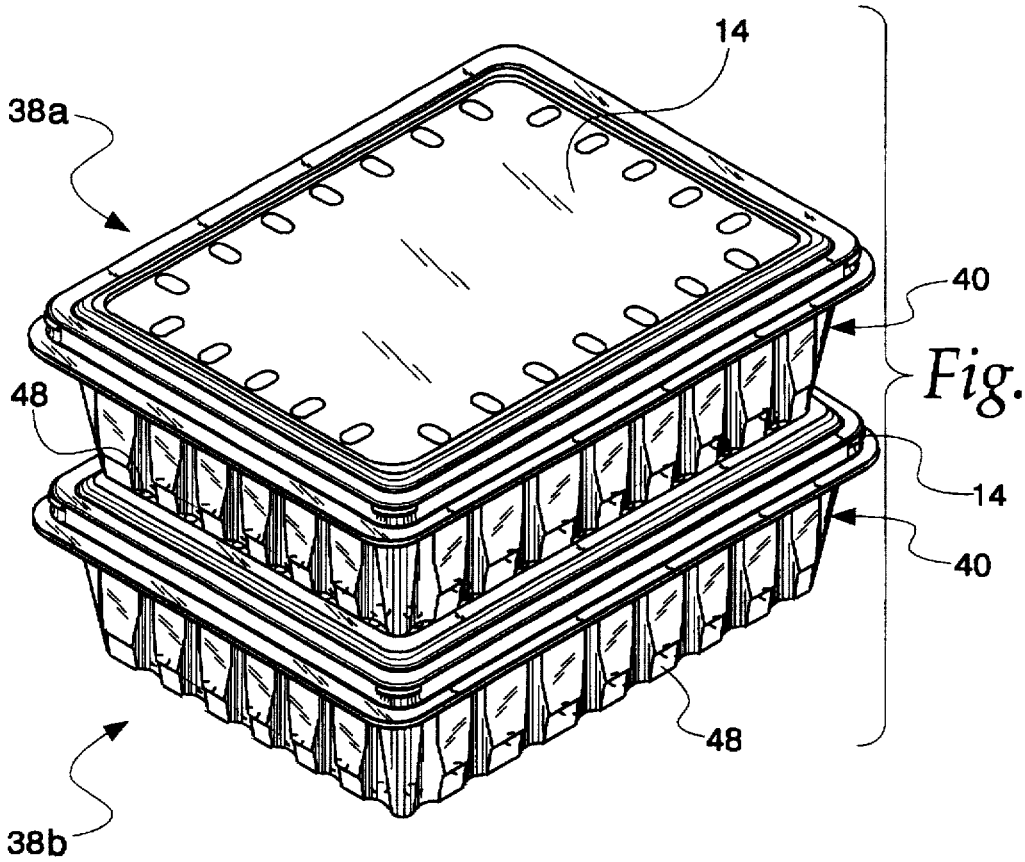
FIG. 7 is an isometric view of two stacked vented-environment packages.
Figure 8:
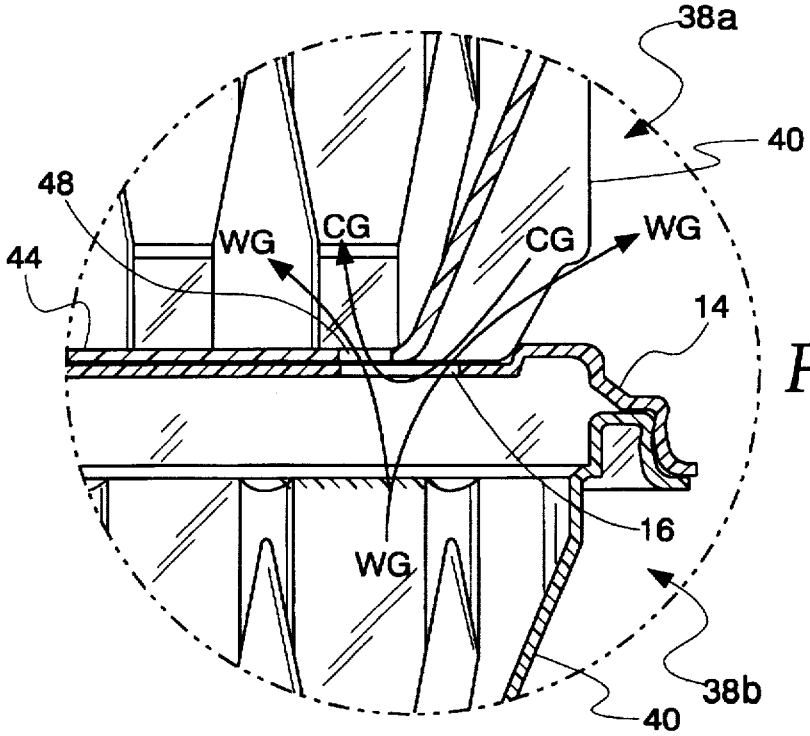
FIG. 8 is an enlarged cross-sectional view illustrating the communication of the opening on the lid with the base opening on the tray in FIG. 7.

FIGS. 7 and 8 accentuate an advantage of the design of the vented-environment package 38. FIG. 7 illustrates an upper vented-environment package **38*a* stacked upon a lower vented-environment package 38*b*. The stacking methodology is analogous to that described with reference to the modified-atmosphere packages 2 in FIGS. 1–5. After all, the lid 14 is the same and the vented-environment tray 40 is almost exactly the same as the modified-atmosphere tray 4 except for the addition the base openings 48. However, the relationship between the base openings 48 of the upper vented-environment package 38*a* and the openings 16 of the lid 14 on the lower vented-environment package 38*b* is notable. This relationship is shown in detail in FIG. 8**.

In the past, when numerous packages were stacked with their lid and base holes aligned, the warm air from the lowest package exited from that package through the lid and entered the vertically adjacent package whose additional heat was added to the exiting warm gas and further passed to the next vertically adjacent package, and so on. The result was that the combined heat produced from the lower packages was passed upward until it escaped from the top package while cool air was being drawn into the stack from the bottom package. This "chimney effect" caused the upper packages to be warmer than the lower packages which results in higher respiration rates and quicker spoiling in those upper packages. A further problem was encountered if the openings became blocked which would stop the natural flow of air.

The vented-environment package 38 solves this problem. As shown in FIG. 8, the openings 16 along the lid 14 are larger than the base openings 48 on the base 44 of the vented-environment tray 40. This is to allow for the exiting of warm gas WG from the lid 14 of the lower vented-environment package **38*b* through the openings 16 while cool gases CG enter through the same openings 16, pass through the base openings 48, and enter into the upper vented-environment package 38*a*. It should be noted that some of the warm gas WG produced by the food in the lower vented-environment package 38*b* also may mix into the cool gas CG and enter the upper vented-environment package 38*a*. In any event, the food contained in the vented-environment packages 38 at the top of the stack will be cooler. If the base openings 48 become blocked for any reason, then the extra exposure to the cool gas CG of the ambient environment at the lid opening 16** is quite beneficial. Several prior art designs incorporated vents along the sides of the packages. But, since the warmest gases rise to the top of the package, these packages are less prone to release all of the heat.

When the vented-environment packages 38 are placed in stacks, not only does the temperature of all vented-environment packages 38 remain at an adequate level, but carbon dioxide, ethylene, and water vapor escape while oxygen is replenished which inhibits the growth of anaerobic bacteria. This process is extremely useful since it increases the shelf life of the foods contained within the vented-environment package 38.

Furthermore, the ability of this lid 14 to enclose the contents in the modified-atmosphere packages 2 and the vented-environment packages 38 is beneficial. The fact that a producer can utilize one lid 14 for nearly every variety of fruit or vegetable is extremely cost effective.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A package for maintaining a modified atmosphere around contents being contained therein when stored in an ambient environment, said modified-atmosphere package comprising:

a tray having a base and side walls extending upwardly from said base, said side walls and said base defining a cavity wherein said contents are disposed, one of said side walls including an indentation extending inwardly toward said cavity;

a membrane attached to a top portion of said side walls and enclosing said cavity;

a structural member detachably connected to said top portion of said side walls, said structural member being disposed above said membrane to prevent said membrane from contacting an external structure, said structural member having at least one opening for directly exposing said membrane to said ambient environment, said membrane being free of contact with said structural member above said cavity such that said exposure to said ambient environment is not impeded; and wherein said structural member has a first stacking means and said base of said tray has a second stacking means on said base to provide for stacking of a first modified-atmosphere package with a second modified-atmosphere package that is positioned below said first modified-atmosphere package, said indentation on said side wall of said first modified-atmosphere package exposing said at least one opening on said structural member of said second modified-atmosphere package to said ambient environment when said first and second modified-atmosphere packages are stacked.

2. The modified-atmosphere package of claim 1, wherein said structural member includes a lid, said top portion of said side walls defining a periphery and said lid being detachably connected to a substantial portion of said periphery.

3. The modified-atmosphere package of claim 2, wherein an upper segment of said lid has said first stacking means.

4. The modified-atmosphere package of claim 1, wherein said first stacking means includes a downwardly projecting recess and said second stacking means includes a downwardly projecting member.

5. The modified-atmosphere package of claim 1, wherein said structural member and said tray are two separate components.

6. The modified-atmosphere package of claim 1, wherein said tray is made of a material selected from the group consisting of polystyrene, polyester, and polypropylene.

7. The modified-atmosphere package of claim 1, wherein said structural member is made of a material selected from the group consisting of polystyrene, polyester, and polypropylene.

8. The modified-atmosphere package of claim 1, wherein said membrane is made of a material selected from the group consisting of polystyrene, polyethylene and polypropylene.

9. The modified-atmosphere package of claim 1, wherein said side walls define a substantially polygonal periphery of said tray.

10. An arrangement for maintaining a controlled environment around packaged contents stored in an ambient environment, said arrangement comprising:

lower and upper vented-environment packages each containing foods which release gases, each of said lower and upper vented-environment packages including:

a tray having a base and side walls extending upwardly from said base, said side walls and said base defining a cavity wherein said contents are disposed, said base having a first stacking means and a first opening adjacent to a corner where one of said side walls meets said base, one of said side walls including an indentation extending inwardly toward said cavity adjacent said first opening; and a lid detachably connected to a top portion of said side walls, said lid having a second opening for releasing said gas and a second stacking means, wherein said lower vented-environment package and said upper vented-environment package are stackable when the first stacking means of said upper vented-environment package engages the second stacking means of said lower vented-environment package, the second opening on the lid of said lower vented-environment package being at least partially aligned with the first opening on said base of said upper vented-environment package and being simultaneously exposed to said ambient environment when said lower and upper vented-environment packages are stacked, said indentation on said one side wall of said upper vented-environment package exposing said second opening on said lid of said lower vented-environment package to said ambient environment when said upper and lower vented-environment packages are stacked.

11. The vented-environment packages of claim 10, wherein said first opening is smaller than said second opening.

12. The vented-environment packages of claim 10, wherein said first stacking means includes a downwardly projecting member and said second stacking means includes a downwardly projecting recess.

13. The vented-environment packages of claim 10, wherein said tray is made of a material selected from the group consisting of polystyrene, polyester, and polypropylene.

14. The vented-environment packages of claim 10, wherein said lid is made of a material selected from the group consisting of polystyrene, polyester, and polypropylene.

15. The vented-environment packages of claim 10, wherein said side walls define a substantially polygonal periphery of said tray.

16. A food storage and transport kit for packaging, storing, and transporting a variety of foods, said kit capable of maintaining each of said variety of foods in a controlled environment while being exposed to an ambient environment, said kit comprising:

at least one modified-atmosphere tray having a first base and first side walls extending upwardly from said first base, said first base having a first stacking means, said modified-atmosphere tray being enclosed by a membrane attached to a top portion of said first side walls;

at least one vented-environment tray having a second base and second side walls extending upwardly from said second base, said second base having a second stacking means and an opening, one of said second side wall having an indentation adjacent to said opening; and at least one lid having a lid opening and a lid stacking means, said lid stacking means being engageable with said first stacking means of said modified-atmosphere tray and said second stacking means of said vented-environment tray, said lid opening being at least partially aligned with said opening on said second base of said vented-environment tray and being simultaneously exposed to said ambient environment when said second stacking means engages said lid stacking means, and wherein said indentation of an upper vented-environment package exposes said lid opening or a lower vented-environment package to said ambient environment when said upper and lower vented-environment packages are stacked, said lid being detachably connected to said modified-atmosphere tray in a first orientation wherein said lid is disposed above said membrane to prevent said membrane from contacting an external structure, said lid opening directly exposing said membrane to said ambient environment, and said lid being detachably connected to said vented-environment tray in a second orientation.

17. The kit of claim 16, wherein said lid opening is larger than said opening on said second base of said vented-environment tray.

18. The kit of claim 16, wherein said first and second stacking means each include a downwardly projecting member and said lid stacking means includes a downwardly extending recess.

19. The kit of claim 16, wherein said modified-atmosphere tray and said vented-environment tray are substantially polygonal.

20. The kit of claim 16, wherein said lid is made of a material selected from the group consisting of polystyrene, polyester, and polypropylene.

21. A package for maintaining a modified atmosphere around contents being contained therein when stored in an ambient environment, said modified-atmosphere package comprising:

a tray having a base and side walls extending upwardly from said base, said side walls and said base defining a cavity wherein said contents are disposed;

a membrane attached to a top portion of said side walls and enclosing said cavity;

a structural member detachably connected to said top portion of said side walls, said structural member being disposed above said membrane to prevent said membrane from contacting an external structure, said structural member having a plurality of openings adjacent to a periphery thereof for directly exposing a substantial portion of said membrane to said ambient environment; and wherein said structural member has a first stacking means and said base of said tray has a second stacking means providing for stacking of a first modified-atmosphere package with a second modified-atmosphere package that is positioned below said modified atmosphere package, segments of said base of said tray of said first modified-atmosphere package being positioned further inwardly of said periphery than said plurality of openings of said second modified atmosphere package when said first and second modified-atmosphere packages are stacked.

22. The modified-atmosphere package of claim 21, wherein said structural member includes a lid, said top portion of said side walls defining a periphery and said lid being detachably connected to a substantial portion of said periphery.

23. The modified-atmosphere package of claim 21, wherein said structural member contacts said membrane only at regions of said membrane that are adjacent said side walls.

24. The modified-atmosphere package of claim 21, wherein each of said plurality of openings is entirely exposed to the ambient environment when stacking.

25. The modified-atmosphere package of claim 21, wherein said structural member and said tray are two separate components.

* * * * *